United States Patent [19]

Sakurai

[11] 4,440,697

[45] Apr. 3, 1984

[54] CARBURETOR

[75] Inventor: Yoshihiro Sakurai, Iwata, Japan

[73] Assignee: Yamaha Hatsudoki Kabushiki Kaisha, Iwata, Japan

[21] Appl. No.: 460,766

[22] Filed: Jan. 25, 1983

Related U.S. Application Data

[63] Continuation of Ser. No. 282,016, Jul. 10, 1981, abandoned.

[30] Foreign Application Priority Data

| | | | |
|---|---|---|---|
| Jul. 11, 1980 | [JP] | Japan | 55-94807 |
| Jul. 11, 1980 | [JP] | Japan | 55-94804 |
| Jul. 11, 1980 | [JP] | Japan | 55-94805 |
| Jul. 11, 1980 | [JP] | Japan | 55-94806 |

[51] Int. Cl.[3] ..... F02M 7/08

[52] U.S. Cl. ..... 261/34 A; 261/18 B; 123/52 M

[58] Field of Search ..... 261/34 A, 34 B; 123/52 M

[56] References Cited

U.S. PATENT DOCUMENTS

| | | | |
|---|---|---|---|
| 1,954,536 | 4/1934 | Prentiss | 261/34 B |
| 2,003,984 | 6/1935 | Timian | 123/52 M |
| 2,111,399 | 3/1938 | Kommer | 261/34 A |
| 4,105,719 | 8/1978 | Saito et al. | 261/34 B |
| 4,117,810 | 10/1978 | John | 261/18 R |
| 4,201,734 | 5/1980 | Ohnishi et al. | 261/34 B |
| 4,211,191 | 7/1980 | Kawamura | 123/52 M |
| 4,251,471 | 2/1981 | Schwander et al. | 261/34 A |
| 4,300,504 | 11/1981 | Tezuka | 123/52 M |
| 4,345,551 | 8/1982 | Bloemers | 123/52 M |

FOREIGN PATENT DOCUMENTS

| | | | |
|---|---|---|---|
| 1217697 | 5/1966 | Fed. Rep. of Germany | 261/34 A |
| 2449047 | 4/1976 | Fed. Rep. of Germany | 261/34 A |
| 2714318 | 10/1978 | Fed. Rep. of Germany | 261/34 A |
| 727027 | 6/1932 | France | 261/34 A |
| 1223426 | 6/1960 | France | 261/34 A |
| 2351267 | 12/1977 | France | 261/34 A |
| 595890 | 7/1959 | Italy | 261/34 R |
| 529658 | 11/1940 | United Kingdom | 261/34 A |

*Primary Examiner*—Tim R. Miles

*Attorney, Agent, or Firm*—Ernest A. Beutler

[57] ABSTRACT

A multi-fuel carburetor embodying a number of improved accelerating pump features. In accordance with one of these features, the accelerating pump discharge is located upstream of the venturi section and is directed in such a way that the depositing of fuel on the throttle valve is minimized and improved distribution to the associated manifold is achieved. In accordance with another feature, the accelerating pump is operated by a linkage which causes the accelerating to begin its discharge stroke before the throttle valve is opened. As another feature, the output of the accelerating pump may be conveniently varied by using a variable bypass in the accelerating pump discharge circuit. As yet another feature, the back or non-pumping side of the accelerating pump is vented to a fuel bowl so as to minimize leakage and to insure return of any fuel that leak passed the accelerating pump to the fuel bowl.

8 Claims, 15 Drawing Figures

Fig-7
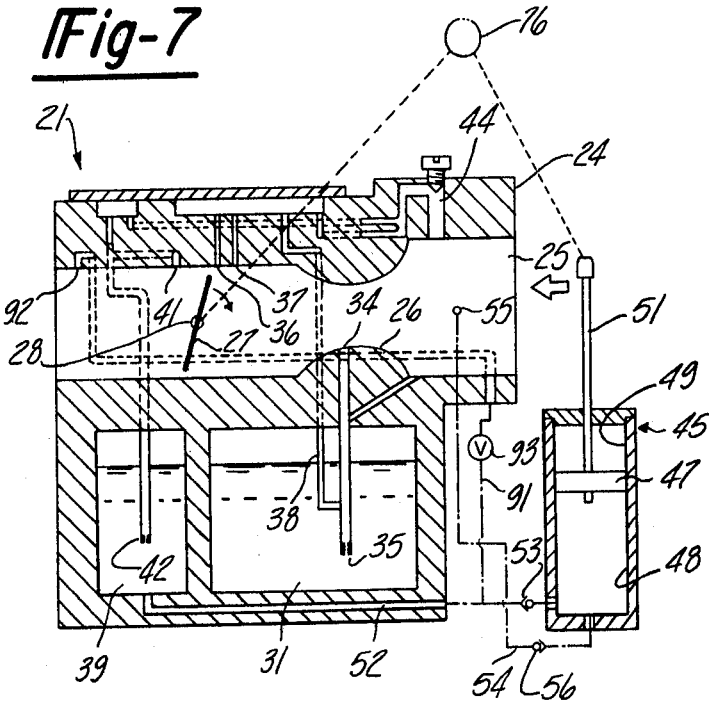
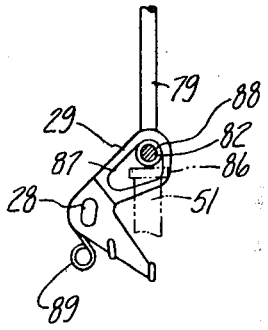
Fig-9
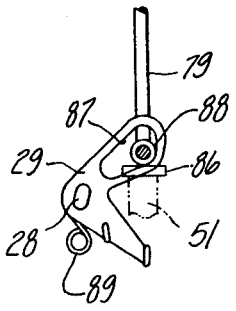
Fig-10

CARBURETOR

This is a continuation of application Ser. No. 282,016, filed July 10, 1981, now abandoned.

BACKGROUND OF THE INVENTION

This invention relates to a carburetor and more particularly to several improvements in the accelerating pump for the carburetor of an internal combustion engine.

The use and function of the accelerating pump of a carburetor is well known. Because of the heavier weight of the fuel and its greater inertia than air, the mixture delivered to the associated engine has a tendency to have an initial weakness upon sudden opening of the throttle valve. The accelerating pump is provided to inject an additional amount of fuel into the intake air during such sudden throttle openings so as to compensate for this condition. Although these purposes are well known, there are a number of difficulties in providing an effective accelerating system for a carburetor. For example, if the discharge of the accelerating pump is positioned too close to the induction system, and particularly downstream of the venturi section of the carburetor, there is a tendency for fuel to be drawn from the accelerating pump by the induction system vacuum.

It is therefore a first object of this invention to provide an improved accelerating pump discharge location.

The accelerating pump discharges the fuel into the induction system at a fairly high pressure and in substantially liquid form. Because of this, there is a good likelihood of fuel from the accelerating pump striking components of the carburetor and being deposited there in liquid form. For example, it is not uncommon for the accelerating pump discharge to be located in such a way that the fuel will strike the throttle valve and be deposited from it. Because of the fact that all of the fuel discharge from the accelerating pump does not enter into the induction air flow, it has heretofore been necessary to provide a greater pump discharge than was actually necessary to serve the particular running condition encountered when the throttle valve is suddenly opened. This, of course, results in poor fuel economy.

It is, therefore, a further object of this invention to provide an accelerating pump discharge located in such a way that the fuel from the accelerating pump will not strike the throttle valve of the carburetor.

Frequently because of spacial and other limitations the carburetor discharge is not disposed symmetrically with the induction passages which is serves. For example, if the carburetor is used in conjunction with an intake manifold that has two or more runners extending from its intake opening, the outlet of the carburetor may not be disposed directly at the midpoint of the inlets to the runners. As a result, there is the likelihood of unequal mixture distribution resulting with the chambers of the associated engine. This problem is particularly prevalent in connection with the accelerating pump discharge because of the aforenoted fact that the discharge from the accelerating pump consists of high pressure liquid fuel. Because of this nature of the discharge from the accelerating pump, mixture strength variations will be magnified.

It is, therefore, yet another object of this invention to provide an improved arrangement for the accelerating pump and induction system of an engine.

As has been noted, the purpose of the accelerating pump is to supply additional fuel during initial opening of the throttle valve so as to avoid leanness. Because of the very nature of the accelerating pumps known in the prior art, the discharge cycle of the pump is not initiated until the opening movement of the throttle valve has already begun. Thus, the very situation which the accelerating pump is intended to rectify has already begun before the accelerating pump begins its operation.

It is, therefore, a still further object of this invention to provide an accelerating pump operating mechanism wherein the pump discharge begins before the throttle valve has opened.

The amount of fuel which the accelerating pump should discharge during each cycle of its operation varies with respect to a number of factors. The volatility of the fuel is an important factor in determining the amount of fuel discharge required. The temperature of the fuel and of the ambient air is also critical and related to the volatility. The greater the degree of volatility of the fuel and the higher the temperature, the lesser amount of accelerating pump discharge required. Because of this it has been the practice to provide some form of mechanical adjustment in the length of the pump stroke which should be varied seasonally. Such arrangements are complicated, add to the cost of the construction, and are frequently not utilized due to their complicated arrangement.

It is, therefore, yet another object of this invention to provide an improved arrangement for varying the accelerating pump discharge.

The most common type of accelerating pump employed is of the piston type. With this type of accelerating pump, an accelerating pump piston is slidably supported in a bore of the carburetor body and displaces fuel into the induction passage when the throttle valve is opened. With such an arrangement, there is the extreme likelihood of fuel leakage between the piston and its supporting bore to the backside of the piston. This results from the difficulty in maintaining an effective seal in this area which is particularly aggravated when the fuel employed is gasoline due to the extremely small molecule size of that fuel. As the fuel gradually seeps behind the piston and accumulates in the chamber that exists on the rear side of it, a hydraulic lock may develop which will render the piston mechanism inoperative. Also, the fuel accumulation behind the accelerating pump piston has a tendency to decrease its effectiveness.

It is, therefore, a yet further object of this invention to provide an improved accelerating pump mechanism.

It is another object of the invention to provide an accelerating pump mechanism wherein fuel leaking past the accelerating pump piston is returned to the fuel system.

It is a still further object of the invention to provide an accelerating pump system wherein the portion of the accelerating pump to the rear of its pumping chamber is vented into the fuel bowl which supplies the accelerating pump.

SUMMARY OF THE INVENTION

A first feature of this invention is adapted to be embodied in a carburetor having an induction passage, a throttle valve for controlling the flow through the induction passage, a venturi section in the induction passage and an accelerating pump operative to discharge fuel upon opening movement of the throttle valve. In accordance with a first feature of the invention, the discharge of the accelerating pump is disposed a substantial distance upstream of the venturi section.

Another feature of the invention is adapted to be embodied in a carburetor having an induction passage, a butterfly-type throttle valve supported on a throttle valve shaft within the induction passage and an accelerating pump operative to discharge fuel upon opening movement of the throttle valve. In accordance with this feature, the discharge of the accelerating pump is directed into the induction passage offset from the axis of the throttle valve shaft toward the downstream portion of the throttle valve for minimizing the impingement of fuel from the accelerating pump upon the throttle valve.

Yet another feature of this invention is adapted to be embodied in an induction system for an internal combustion engine including a manifold having an inlet opening and outlet means offset from the inlet opening, a carburetor in registry with said inlet opening for delivery a fuel air charge thereto, and an accelerating pump in the carburetor for delivering a quantity of fuel upon opening of the throttle valve. In accordance with this feature, the outlet of the accelerating pump is directed toward the center of the manifold outlet means.

Still another feature of this invention is adapted to be embodied in a charge forming device comprising an induction passage, a throttle valve for controlling the flow through the induction passage, and an accelerating pump. In accordance with this feature means are provided for actuating the accelerating pump prior to movement of the throttle valve in its opening direction.

A still further feature of this invention is adapted to be embodied in a charge forming device for an internal combustion engine comprising an induction passage, a fuel reservoir, and an accelerating pump for discharging fuel from the reservoir to the induction passage. In accordance with this feature of the invention means return a portion of the fuel discharged from the accelerating pump to the reservoir.

A yet further feature of the invention is adapted to be embodied in a charge forming device for an internal combustion engine having a fuel bowl, an accelerating pump having a housing defining a chamber and a pumping member supported for movement within the chamber for delivering fuel from one side of the pumping member. In accordance with this feature means vent the chamber on the other side of the pumping member to the fuel bowl above the level of the fuel therein.

A still further feature of the invention is adapted to be embodied in a charge forming device as defined in the preceding paragraph. In accordance with this feature, means are provided for returning any fuel leaking past the pumping member back to the fuel bowl.

A still further feature of this invention is adapted to be embodied in a charge forming device for an internal combustion engine having a first fuel bowl for containing a first fuel, a second fuel bowl for containing a second fuel, and an accelerating pump for pumping fuel from the first fuel bowl. The accelerating pump includes a housing defining a chamber and a pumping member supported for movement within the chamber for delivering fuel from one side of the pumping member upon its movement. In accordance with this feature of the invention, means are provided for returning fuel leaking past the pumping member to the second fuel bowl.

BRIEF DESCRIPTION OF THE DRAWINGS

FIG. 7 is a schematic cross-sectional view showing the circuitry of the carburetor.

FIG. 9 is an enlarged view showing the throttle actuating and accelerating pump actuating mechanism in a first position.

FIG. 10 is a view, in part similar to FIG. 9, showing the mechanism is another position.

DETAILED DESCRIPTION OF THE PREFERRED EMBODIMENTS

Figure 1:
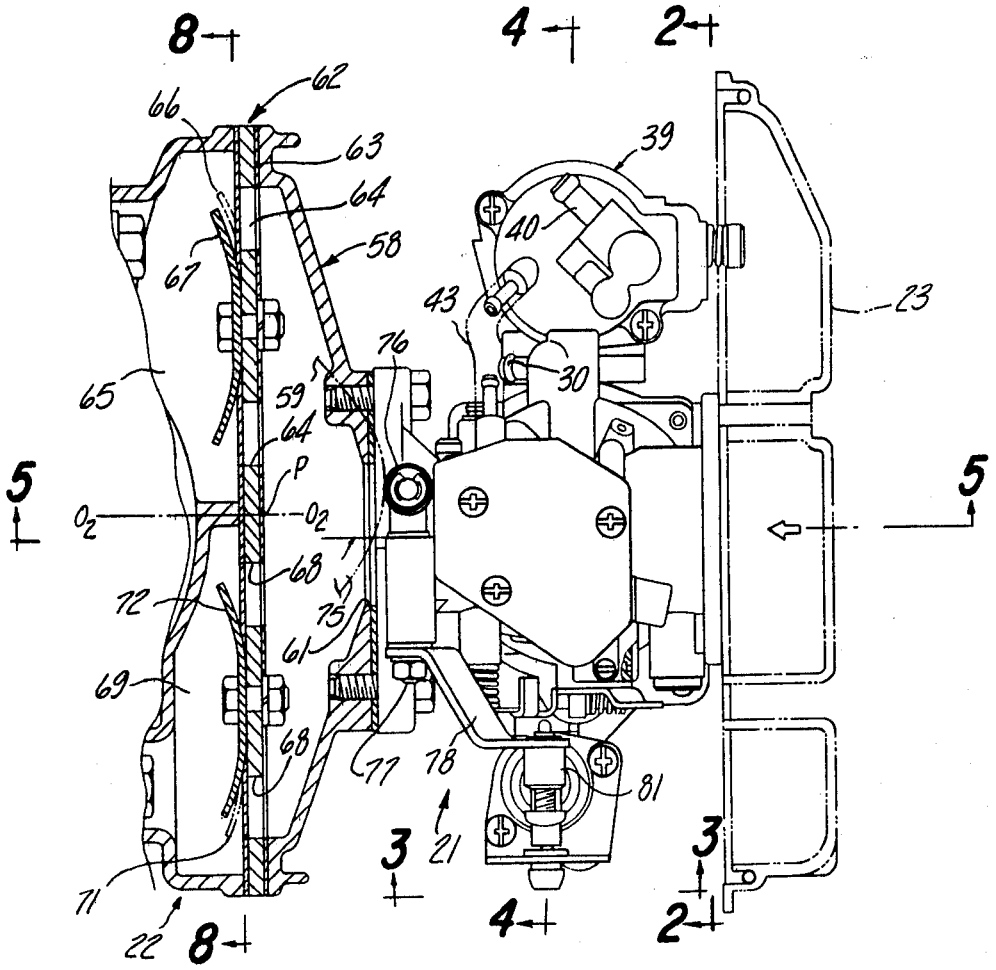
FIG. 1 is a partial top plan view of an internal combustion engine embodying a multi-fuel carburetor constructed in accordance with this invention wherein the manifold is shown in section and the associated air inlet in phantom.
Figure 2:
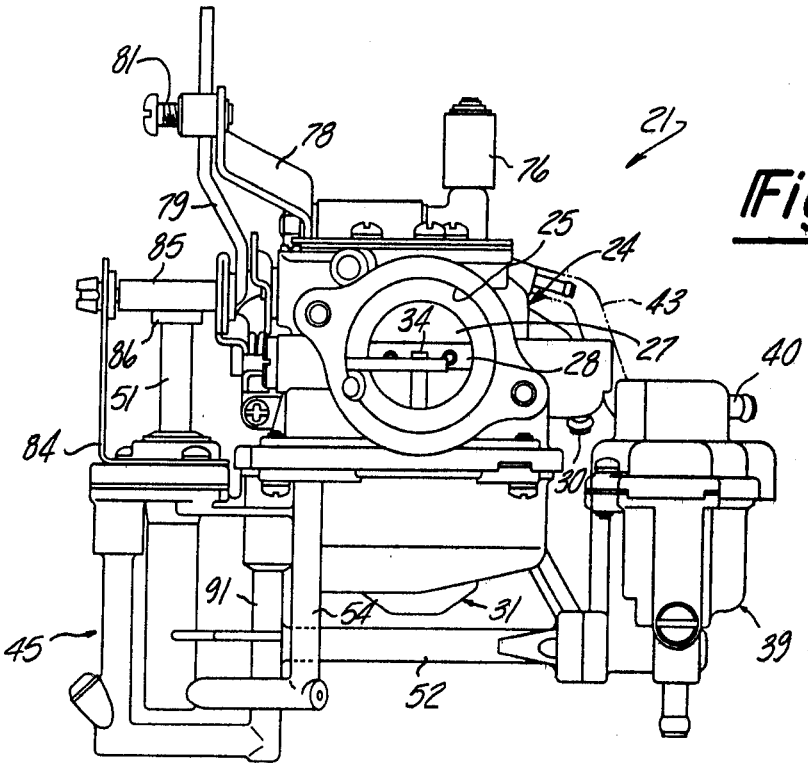
FIG. 2 is a side elevational view of the inlet side of the carburetor and is taken generally along the line 2—2 of FIG. 1.
Figure 3:
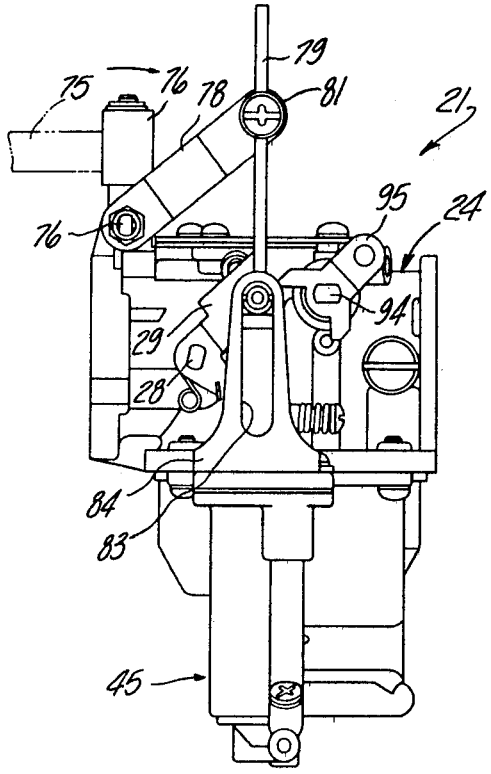
FIG. 3 is an end elevational view of the carburetor and is taken along the line 3—3 of FIG. 1.
Figure 4:
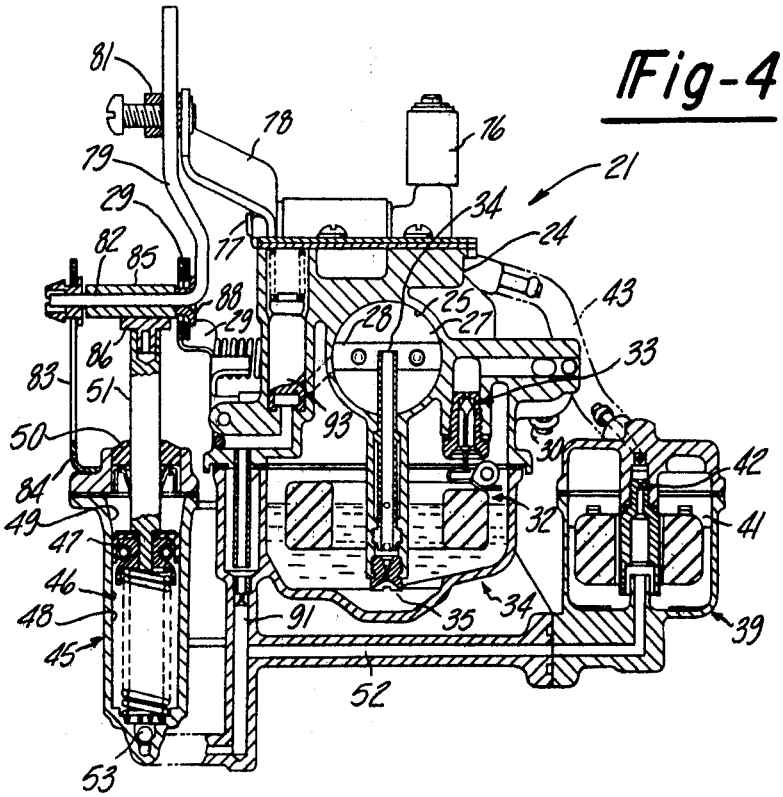
FIG. 4 is a cross-sectional view taken along the line 4—4 of the FIG. 1.
Figure 6:
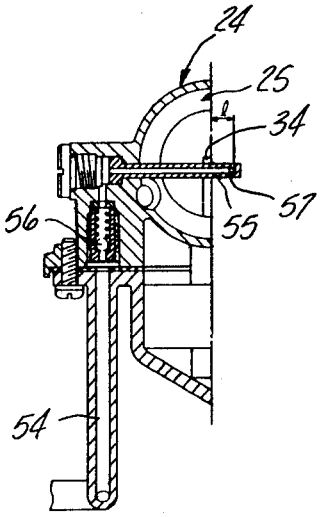
FIG. 6 is a cross-sectional view taken through the discharge nozzle of the accelerating pump circuit of the carburetor.

Referring first to the embodiment of FIGS. 1 through 10, a carburetor constructed in accordance with this invention is identified generally by the reference numeral 21. As will become apparent, the carburetor 21 is particularly adapted for dual fuel operation and is associated with a two-cycle, two-cylinder outboard motor which is shown only partially and which is identified generally by the reference numeral 22. The carburetor 21 is also provided with an inlet device, shown in phantom and identified generally by the reference numeral 23. The carburetor 22 has a main body 24 that defines an intake passage 25 which includes a venturi section 26. A throttle valve 27 is rotatably supported in the intake passage 25 downstream of the venturi section 26 by a throttle valve shaft 28. The throttle valve shaft 28 is rotatably supported by the carburetor body 24 and has an actuating lever assembly 29 affixed to one of its sides for rotatably positioning the throttle valve 27 in a manner to be described.

The carburetor 21 is of the dual fuel type and includes a main fuel bowl, indicated generally by the reference numeral 31, which is adapted to contain the main running fuel which may be kerosene or some other fuel having a relatively low volatility and is supplied via an inlet 30. The level of this fuel in the main fuel bowl 31 is controlled by a float assembly, indicated generally by the reference numeral 32, which operates a needle valve, indicated generally by the reference numeral 33, in a known manner. The main fuel system has a main discharge nozzle 34 which is supplied with metered fuel through a main fuel jet 35 positioned in the fuel bowl 31. The main fuel discharge nozzle 34 is located at the throat of the venturi section 26.

The main running fuel from the main fuel bowl 31 is also supplied to a pair of transition ports 36 and 37 that are positioned immediately adjacent the idle position of the throttle valve 27 via a passage 38 which is fed from the main jet 35. As is well known, as the throttle valve 27 is opened beyond its idle position, the ports 36 and 37 will be progressively opened so as to supply fuel for the off idle running condition.

A secondary fuel supply is provided for cold starting enrichment, idle running and accelerating pump operation. The second fuel supply includes a secondary fuel bowl, indicated generally by the reference numeral 39, and which is adapted to be filled with a secondary fuel of higher volatility such as gasoline from an inlet fitting 40 to a level as controlled by a float 41 and associated needle valve (not shown). The secondary fuel bowl 39 supplies an idle discharge port 41 via a metering jet 42 and associated passages. These passages include an external, flexible conduit 43 that extends from the fuel bowl 39 to the main body 24 of the carburetor 21. Air for idle operation is also introduced and mixed with the fuel before discharge from the idle port 41 by means of a passage 44 (FIG. 7) formed in the carburetor body 24. The secondary fuel bowl 39 also provides fuel for an accelerating pump assembly, indicated generally by the reference numeral 45. The accelerating pump 45 includes a housing that defines a pump bore 46 in which a piston 47 reciprocates. The piston 47 divides the bore 46 into a pumping cavity 48 and a back cavity 49. The back cavity is sealed by a combined seal and closure 50. The piston 47 is connected to an actuating rod 51 which passes through the closure 50 for movement in a downward or pumping direction upon opening of the throttle valve 27 and return movement upon closure of the throttle valve 27 by means of a mechanism to be described.

The pumping cavity 48 is supplied with fuel from the secondary fuel bowl 39 by means of a supply line 52 and check valve 53. The check valve 53 functions, as is well known, so as to permit fuel to flow from the line 52 into the pumping cavity 48 during the upward or return stroke of the piston 47. The check valve 53, however, closes upon downward movement of the piston 47 so that fuel will not be returned to the secondary fuel bowl 39.

The accelerating pump 45 is also provided with a discharge conduit 54 (FIGS. 6 and 7) which leads from the lower portion of the pumping chamber 48 and which terminates at a discharge pipe 55 that is positioned in the induction passage 25 at a substantial distance upstream of the venturi section 26. A check valve 56 is positioned at the juncture between the conduit 54 and discharge nozzle 55 so as to prevent air from being drawn into the pumping chamber 48 during the return stroke of the piston 47. Because of the position of the discharge nozzle 55 a substantial distance upstream of the venturi section 26, the induction system vacuum will not tend to draw fuel from the discharge nozzle 55 during times when the accelerating pump 45 is not operative. The accelerating pump discharge nozzle 55 has a discharge opening 57 that is oriented so that liquid fuel discharged from the accelerating pump will not impinge upon the throttle valve 27 and, furthermore, so as to insure equal distribution of the accelerating pump fuel to the cylinders of the associated engine, as will now be described.

Figure 5:
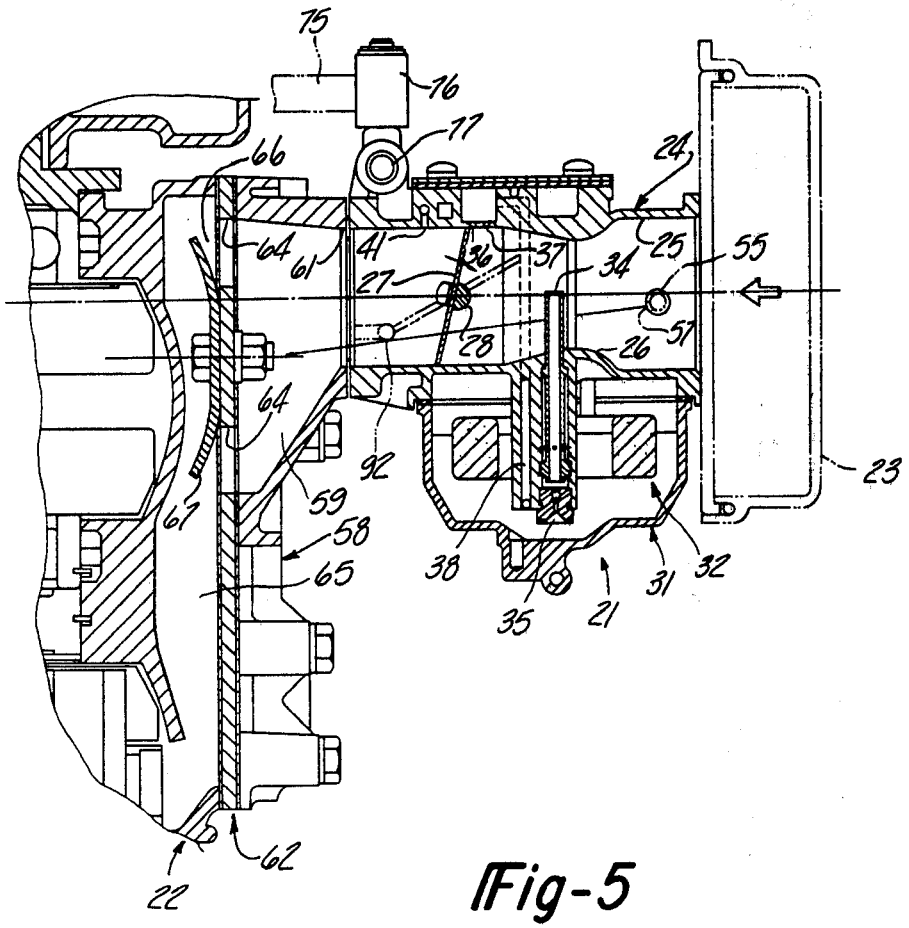
FIG. 5 is a cross-sectional view taken along the line 5—5 of FIG. 1.
Figure 8:
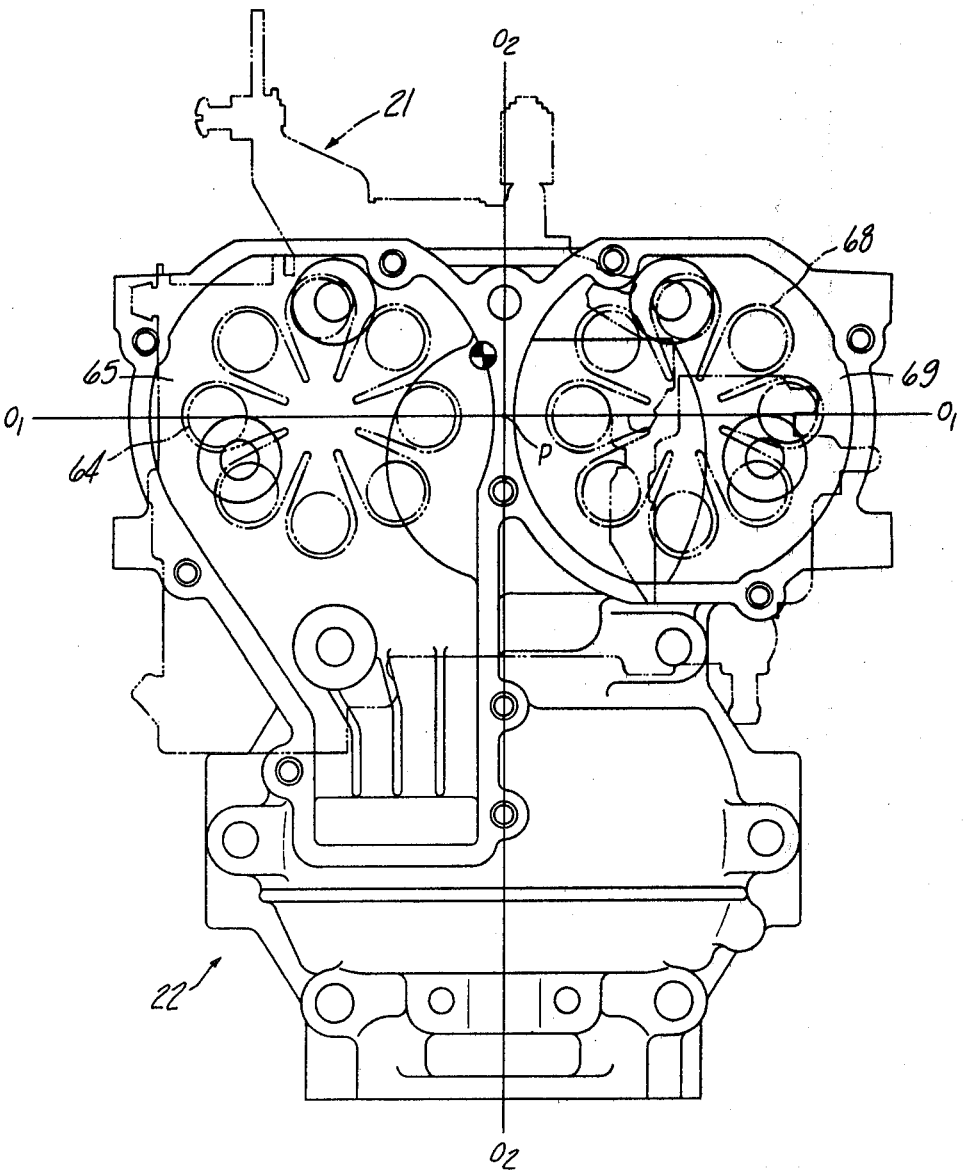
FIG. 8 is a cross-sectional view taken along the line 8—8 of FIG. 1 and shows the geometric relationship of the carburetor to the intake manifold.

Referring primarily to FIGS. 1, 5 and 8, as has been noted the engine 22 is of the two-cylinder, two-cycle type. The engine 22 is adapted for marine application and comprises an outboard engine in which one cylinder is vertically disposed above the other and the crankshaft extends vertically. The engine also, being of the two-cycle type, is designed for crankcase compression and the intake charge is delivered to the respective crankcases of the engine. A manifold, indicated generally by the reference numeral 58, is interposed between the carburetor 21 and the main body of the engine 22. The manifold 58 has an internal conduit 59 that extends from an inlet opening 61 and terminates adjacent a check valve assembly, indicated generally by the reference numeral 62. The check valve assembly 62 is comprised of a valve plate 63 in which a first series of apertures 64 is formed which communicate with a first intake passage 69 that serves the lowermost crankcase of the associated engine. Reed type check valves 66 control the flow through the passages 64 to the passage 65. A backup plate 67 limits the degree of opening of the check valve 66 in a known manner. A second series of passages 68 serve a second intake passage 65 which communicates with the uppermost crankcase. Reed type check valves 71 control the communication of the passages 68 with the passage 69 and a backup plate 72 is also provided for controlling the degree of opening of the valves 71. As may be seen from these figures, the centers of the inlet port 64 and 68 are disposed symetrically about a horizontally disposed centerplane $0_1$—$0_1$ and a vertically disposed center plane $0_2$—$0_2$ which intersect at a point P that constitutes the geometric center of these inlet passages 64 and 68. Because of the geometry of the engine, the centerline of the manifold inlet 61 and the intake passage 25 of the carburetor 21, the line 0—0, is offset both horizontally and vertically from the point P. This offset is clearly shown in FIG. 8.

Because of the offset as aforenoted, there is a likelihood of variation in mixture strength delivered to the two cylinders, primarily when the accelerating pump 45 discharges. This is due to the fact that the accelerating pump 45 discharges liquid fuel at a high pressure and unless this liquid fuel is directed toward the point P, there is a good likelihood of variations in mixture distribution. To avoid this the accelerating pump discharge nozzle 57 is offset slightly below the horizontal centerline 0—0. The nozzle 55 also extends radially inwardly of the induction passage 25 beyond the vertically extending centerline $0_2$—$0_2$. The discharge nozzle opening 57 is displaced from this axis a distance 1 which is equal to the amount of offset of the center 0 from the point P. In addition to the horizontal and vertical offset of the nozzle opening 57, it is also disposed so as to discharge at an angle to the horizontal as shown in FIG. 5 so that its point of discharge is directly aimed at the point P. Thus, the fuel distribution from the accelerating pump nozzle will be equal to the two series of reed valve inlet openings 64 and 68. Furthermore, as should be readily apparent from FIG. 5, the offset is on the same side of the throttle valve shaft 28 as the portion of the throttle valve 27 which moves downstream as the throttle valve 27 opens. Thus, this portion of the throttle valve moves away from the fuel discharge from the accelerating pump nozzle outlet 57 and minimizes the likelihood of impingement of liquid fuel on the throttle valve 27.

The mechanism for opening the throttle valve 27 and actuating the accelerating pump 45 will now be described. This mechanism includes structure for actuating the accelerating pump 45 prior to actual opening of the throttle valve 27. In this way it will be insured that there will be no lean period when the throttle 27 is opened and an improper fuel air mixture will exist.

The actuating mechanism is best shown in FIGS. 1 through 5 and 9 and 10. It includes a cam 75 which is controlled by the vehicle operator and rotates in an opening direction as indicated by the arrow A in FIG. 1. The cam 75 contacts a roller follower 76 which is journaled on the offset end of a shaft 77 that is suitable journaled on the carburetor body 24. An actuating lever 78 is non-rotatably affixed to the other end of the shaft 71. The opposite end of the actuating lever 78 is adjustably connected to a pump actuating lever 79 by means of a coupling 81. The pump actuating arm 79 has an offset end 82 that gives the lever 79 a generally L shape. The outer end of the arm 82 is guided within a vertically extending slot 83 defined by a bracket 84 that is affixed in any suitable manner to the carburetor body 24. A roller 85 is journaled on the arm 82 and engages an actuating portion 86 provided at the upper end of the accelerating pump rod 51.

Intermdiate the roller 85 and upstanding portion of the pump actuating arm 79, the arm portion 82 extends through a generally triangular shaped opening 87 formed in the throttle valve lever 29. An anti-wear collar 88 encircles this portion of the arm 82. It should be noted from FIGS. 9 and 10 that the opening 87 is considerably larger than the anti-wear member 88 so that there will, in effect, be provided a lost motion connection between the lever 79 and the throttle valve lever 29. A torsional spring 89 engages the lever 29 to rotate the lever 29 and throttle valve 27 to its idle position.

FIGS. 1 through 5 and 9 show the accelerating pump and throttle valve actuating system when it is in its normal idle condition. As seen in FIG. 9, the roller 88 is position at the upper end of the slot 87. When the cam 75 is rotated in the direction of the arrow A, as seen in FIG. 1, the roller 76 will be moved so as to rotate the throttle actuating shaft 77 in the direction of the arrow B in FIG. 3. This will cause the arm 78 to also rotate in the same direction as viewed in this figure to move the actuating lever 79 downwardly. Because of the contact of the roller 85 with the pump actuator 86, the accelerating pump 45 will be immediately actuated so as to drive fuel from the outlet passage 54 past the check valve 56 for discharge from the nozzle 55 and specifically its opening 57 in the direction aforenoted. At this time there will be no corresponding rotation of the throttle lever 29 due to the clearance of the opening 87. This initial actuation of the accelerating pump occurs until the roller 88 engages the lowermost surface of the lever defining the slot 87 (FIG. 10). The throttle valve 27 will then commence to open.

As has been noted, the secondary fuel bowl 39 supplies a cold starting mixture in addition to serving the idle and accelerating pump circuits, which have already been described. To accomplish this, a starting fuel passage 91 intersects the accelerating pump supply passage 52 and terminates in a cold starting enrichment port 92 positioned downstream of the throttle valve 27 and in close proximity to the manifold inlet opening 61. A starter valve, indicated schematically at 93 in FIG. 7, is interposed in this circuit. The valve 93 may be of any known type and has an actuating shaft 94 that is operated by a cold starting lever 95 which is, in turn, adapted to be operated in any known manner as by means of a flexible transmitter (not shown). When the valve 93 is opened, cold starting fuel can be drawn from the bowl 39 and passages 52 and 91 for discharge through the cold starting port 92.

Although it is believed that the operation of the carburetor 21 is clear from the foregoing description, a brief summary will be given here. During cold starting and cold running, addition enrichment of the more volatile fuel from the secondary fuel bowl 39 may be provided by opening the starter valve 93. The fuel will then be discharged through the cold starting port 92.

With the engine running and the throttle valve 29 in its idle position, fuel will be drawn from the secondary fuel source 39 through the metering jet 42 and idle discharge passage 41. As the throttle valve 29 is progressively opened, the ports 36 and 37 will be uncovered and the main fuel will be supplied from the main fuel bowl 31. Upon continued opening of the throttle valve 29, the main fuel discharge circuit including the discharge nozzle 34 will begin to operate.

Also, as has been previously noted, prior to opening of the throttle valve 27 by actuation of the cam 75, the accelerating pump 45 will be operated so as to discharge fuel from the secondary fuel bowl 39 into the intake passage. This initial actuation of the accelerating pump 45 prior to actual opening of the throttle valve 27 will insure good acceleration without hesitations caused due to leanness which might otherwise exist. Also, the accelerating pump discharge opening 57 is oriented so that there will be equal fuel distribution to the cyliners of the engine.

Figure 11:
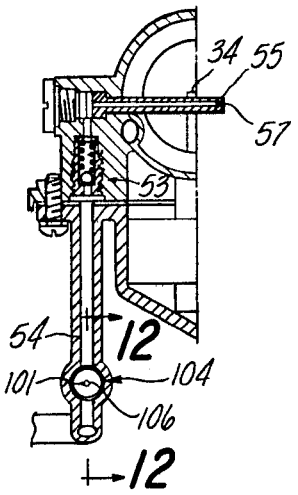
FIG. 11 is a cross-sectional view, in part similar to FIG. 6, showing another embodiment of the invention.
Figure 12:
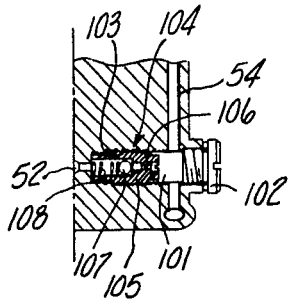
FIG. 12 is a cross-sectional view taken along the line 12—12 of FIG. 11.
Figure 13:
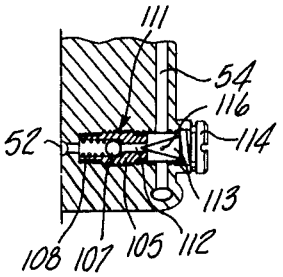
FIG. 13 is a cross-sectional view, in part similar to FIG. 12, showing a still further embodiment of the invention.

As has been previously noted, in many instances it is necessary or desirable to provide an arrangement for adjusting the amount of discharge of the accelerating pump to compensation for variations in temperature, fuel or the like. This has conventionally done by adjusting the pump stroke or, in fact, changing elements of the accelerating pump. FIGS. 11 through 13 illustrate two embodiments of the invention wherein the necessity of providing a mechanical linkage adjustment are avoided. As will become apparent, this is accomplished by bypassing a controlled amount of fuel from the accelerating pump discharge back into the secondary fuel bowl 39.

Referring first to the embodiment of FIGS. 11 and 12, only that portion of the carburetor necessary to understand this embodiment of the invention has been illustrated. Furthermore, components which are the same as those in the previously described embodiment have been identified by the same reference numerals and a further description of these details will not be repeated, except as insofar as is necessary to describe the operation and construction of this embodiment.

A bypass passage 101 is drilled into the body of the carburetor 24 to intersect the accelerating pump discharge conduit 54 and supply conduit 52. The outer end of the drilled passage 101 is closed by a plug 102. The portion of the passage 101 adjacent the passage 52 is threaded, as at 103, to receive a bypass valve assembly, indicated generally by the reference numeral 104. The bypass valve assembly 104 consists of a valve body 105 having a metered orifice 106 formed therein. A ball type check valve 107 is urged by a spring 108 to close the passage 106. The size of the passage 106 will determine the amount of fuel bypassed.

When the accelerating pump is actuated, fuel will be driven out of the discharge conduit 54. The pressurized fuel acting on the ball valve 107 causes it to unseat and open the metered passage 106 so that a portion of the fuel pumped by the accelerating pump 45 will be returned to the fuel bowl conduit 52. As has been noted, the amount of the fuel bypassed will depend upon the size of the orifice 106.

The spring 108 and specifically its preload can be adjusted by positioning the valve body 105 at the desired depth into the bore 101. It should be noted that the spring 108 should provide a slightly greater resistance to flow than the spring of the discharge check valve 53 of the accelerating pump. If this were not true, the accelerating pump check valve 53 might never open and all of the fuel discharged by the accelerating pump 45 would be returned back to its fuel bowl 39.

To permit changes in the amount of accelerating pump discharge delivered to the nozzle 55, it is merely necessary to remove the plug 102 and replace the valve 104 with a valve having a different sized orifice 106. This replacement may be conveniently made and does not require adjustment of the actuating linkage for the accelerating pump.

If desired, an arrangement may be provided wherein the accelerating pump return is controlled adjustably. Such an embodiment is shown in FIG. 13. In this embodiment, the return valve, indicated generally by the reference numeral 111, has a relatively large orifice 112. An adjustable needle 113 cooperates with the orifice 112 so as to permit adjustment of the effective size of the opening. The needle 113 a sloted head 114 which is accessible externally of the body of the carburetor so that the adjustment in the effective orifice size may be made without necessitating any disassembly of the carburetor.

A small bypass port 116 extends through the needle valve 113 so as to permit open communication in the conduit 54.

In connection with the adjustable embodiment of FIG. 13 it is to be understood that rather than making the adjustment of the valve 113 manually, through a suitable temperature responsive mechansim the adjustment may be accomplished automatically.

As has been noted, the back chamber 49 of the accelerating pump 45 (FIG. 4) is in effect sealed by the piston 47 at one side and by the combined seal and closure 50 at the other side. Under some circumstances this may give rise to a problem which could cause malfunction of the accelerating pump. That is, the gasoline fuel has a tendency to leak past the piston 47 due to the relatively small molecule size of this fuel. Futhermore, the downward movement of the piston 47 cause a partial vacuum to be created in the backchamber 49 which further aggravates the leakage problem. These problems are avoided by means of the construction shown in FIG. 14.

Figure 14:
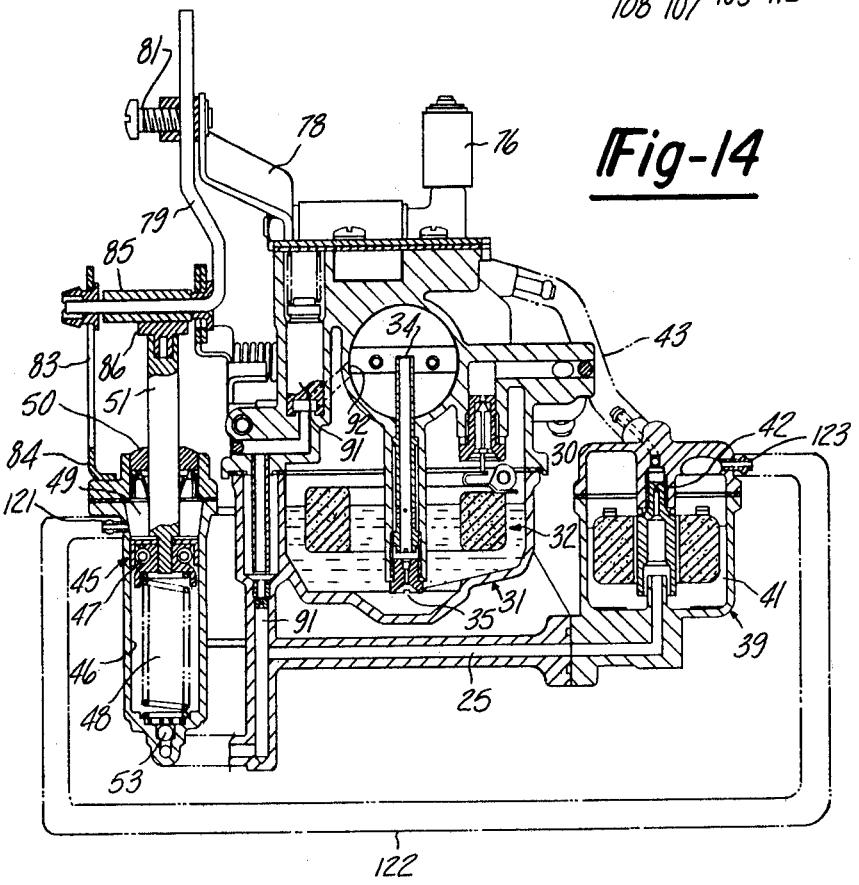
FIG. 14 is a cross-sectional view, in part similar to FIG. 4, showing a still further embodiment of the invention.

In the embodiment of FIG. 14, the carburetor as a whole is of the type previously described and, for that reason, only the arrangement for accommodating and minimizing leakage in the accelerating pump 45 will be described. In this embodiment, a vent and fuel return nipple 121 is provided in the accelerating pump body just slightly above the most retracted position of the piston 47. A flexible conduit 122 interconnects the pipe 121 with a fuel return and venting pipe 123 that is formed in the secondary float bowl 39 above the level of fuel therein.

Upon rapid downward movement of the accelerating pump piston 47 the back chamber 49 will be exposed to atmospheric pressure by the venting arrangement which connects this chamber with the fuel bowl 39 above the level of the fuel therein. This consists of the pipes 123, conduit 122 and pipe 121. Thus, the likelihood of fuel leakage is minimized.

In addition to the foregoing, any fuel that does leak past the piston 47 will be driven back to the fuel bowl 39 when the piston 47 returns to its upward or normal position as shown in FIG. 14. Thus, it need not be necessary to remove the combined seal and closure 50 to remove any fuel which may leak past the piston 47.

Figure 15:
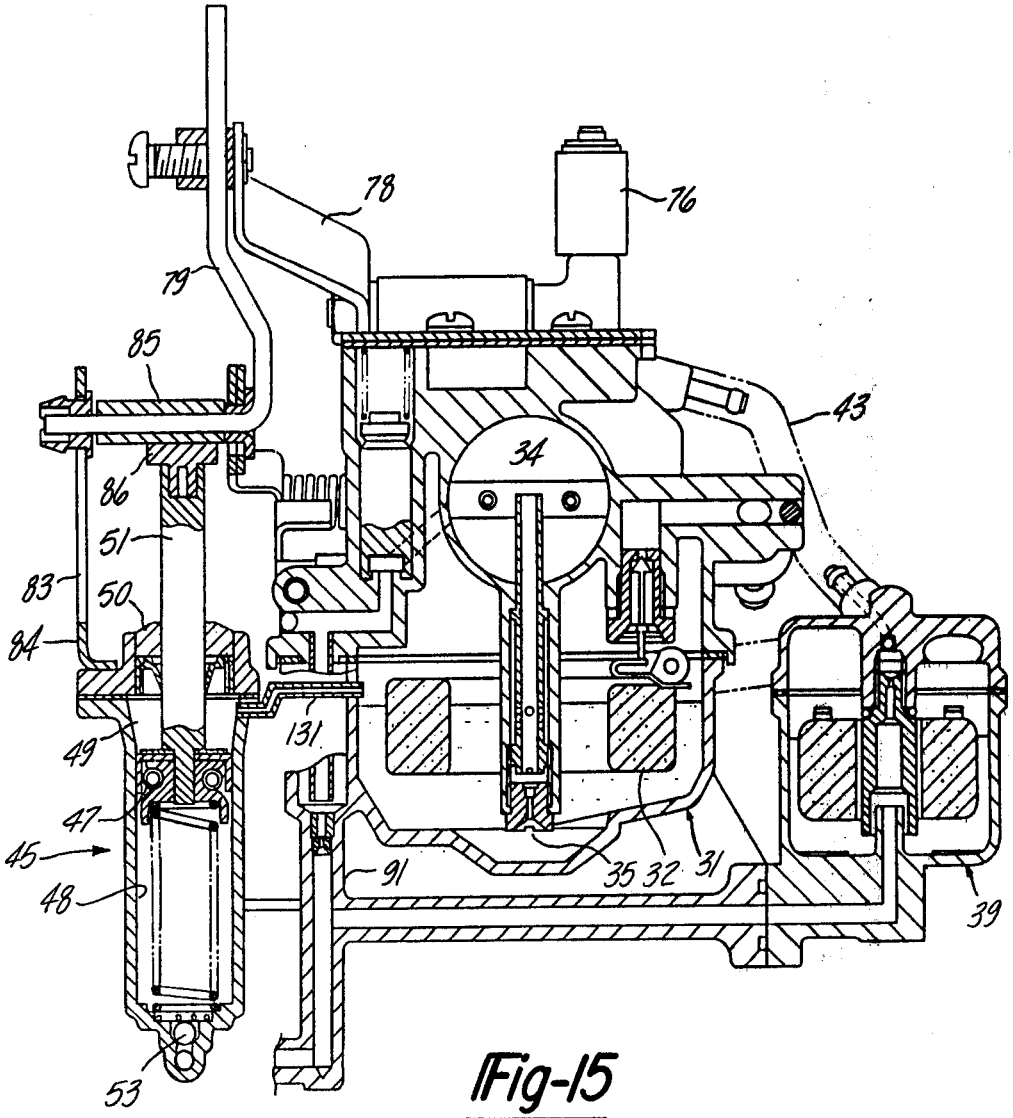
FIG. 15 is a cross-sectional view, in part similar to FIGS. 4 and 14, showing a still further embodiment of the invention.

Rather than return the fuel which passes the accelerating pump piston 47 to the fuel bowl from which it was supplied, which may necessitate an external conduit as with the embodiment of FIG. 14, the fuel may be returned directly to the primary fuel bowl. FIG. 15 illustrates such an embodiment and in this figure only those components which are different from the embodiment of FIG. 14 will be described in detail. All remaining components have been identified by the same reference numerals as previously applied and the description of these elements will not be repeated, except insofar as is necessary to understand the operation of this embodiment.

In this embodiment a fuel return and venting conduit 131 extends from the accelerating pump back chamber 49 to a point in the main fuel bowl 31 above the normal level of fuel therein. As with the preceding embodiment, the conduit 31 maintains atmospheric pressure in the back chamber 49 during the pumping stroke of the piston 47. In addition, accumulated fuel which may bypass the piston 47 will be returned to the fuel bowl 31. Although gasoline will be returned to the kerosene fuel bowl 31, the amount so returned is relatively small and will not deleteriously effect to the performance of the engine.

Several embodiments of the invention have been described in conjunction with a multi-fuel carburetor. It is to be understood that certain of these features may be employed with carburetors with other than the multi-fuel type. Also, although the fuels have been referred to as kerosene and gasoline, it is to be understood that different fuels may be employed such as alcohol and gasoline, or mixtures. In addition to the embodiments disclosed various other changes and modifications may be made without department from the spirit and scope of the invention, as defined by the appended claims.

I claim:

1. In an induction system for an internal combustion engine, a manifold having an inlet opening and outlet means offset from said inlet opening, a carburetor in registry with said inlet opening for delivering a fuel air charge thereto, and an accelerating pump in said carburetor for delivering fuel upon opening of said throttle valve, the improvement comprising the discharge of said accelerating pump being directed toward the center of said manifold outlet means.

2. A carburetor as set forth in claim 1 wherein the outlet means comprise a plurality of outlet passages, the accelerating pump discharge being directed toward the geometric center of said openings.

3. In combination with a carburetor having an induction passage, a throttle valve for controlling the flow through said induction passage, a venturi section in said induction passage and in accelerating pump operative to discharge fuel upon opening movement of said throttle valve, the discharge of said accelerating pump being disposed a substantial distance upstream of said venturi section and an intake manifold having an inlet with which the downstream end of said carburetor induction passage cooperates and outlet means, the outlet means being offset from the axis of the induction passage of said carburetor, the improvement comprising said accelerating pump discharge being directed toward the center of said manifold outlet means.

4. A carburetor as set forth in claim 3 wherein the accelerating pump discharge is offset from the longitudinal axis of the induction passage.

5. A carburetor as set forth in claim 4 wherein the accelerating pump discharges in a direction not parallel to the longitudinal axis of the induction passage.

6. A carburetor as set forth in claim 3 wherein the accelerating pump discharge is directed so as to minimize impingement of the fuel issuing from said accelerating pump upon said throttle valve.

7. A carburetor as set forth in claim 6 wherein the throttle valve is of the butterfly-type rotatably supported upon a throttle valve shaft in the induction passage, the discharge from the accelerating pump being directed toward the downstream side of said butterfly-type throttle valve.

8. In a charge forming device comprising an induction passage, a throttle valve for controlling the flow through said induction passage, and an accelerating pump, the improvement comprising means for actuating said accelerating pump prior to movement of said throttle valve in an opening direction comprising an actuating rod for said accelerating pump, control means including pin means engaging said actuating rod for simultaneous and continuous movement therebetween, said pin means extending transversely beyond said actuating rod, a throttle lever operatively connected to said throttle valve, said throttle lever having an opening formed therein through which said pin means projects for establishing a lost motion connection between said pin means and said throttle valve.

* * * * *